United States Patent [19]

Margolis

[11] 4,017,907

[45] Apr. 19, 1977

[54] SANITARY HAND COVERING WITH SHAPING FASTENERS

[76] Inventor: Hyman J. Margolis, 3036 N. 45th St., Milwaukee, Wis. 53210

[22] Filed: Mar. 3, 1976

[21] Appl. No.: 663,322

[52] U.S. Cl. ..... 2/158

[51] Int. Cl.[2] ..... A41D 19/00

[58] Field of Search ..... 2/158, 160, 161, 169, 2/167

[56] References Cited

UNITED STATES PATENTS

| | | | |
|---|---|---|---|
| 3,374,487 | 3/1968 | Slimovitz | 2/161 R |
| 3,508,280 | 4/1970 | Osborn | 2/159 |
| 3,532,344 | 10/1970 | Masstab | 2/160 X |
| 3,774,242 | 11/1973 | Owen | 2/158 |
| 3,805,297 | 4/1974 | Margolis | 2/158 |

*Primary Examiner*—G. V. Larkin

*Attorney, Agent, or Firm*—Wheeler, Morsell, House & Fuller

[57] ABSTRACT

A sanitary hand covering is made of an elongated rectangular piece of plastic film which is folded over upon itself and is heat sealed together on opposing side edges and along a central portion to divide the interior of the hand covering into a thumb stall and a finger stall. Strips of fastener material are attached to the back of the hand covering and are so positioned that slack portions of the hand covering can be folded over and fastened down to take up the slack between the rectangular hand covering and a hand inserted therein. In one embodiment material to provide improved grip on articles to be handled is secured to the face of the hand covering that touches the article on at least the portion covering the thumb.

6 Claims, 5 Drawing Figures

SANITARY HAND COVERING WITH SHAPING FASTENERS

BACKGROUND OF THE INVENTION

This invention relates to mitten type disposable hand coverings such as disclosed in U.S. Pat. No. 3,805,297. This type of sanitary hand covering is rectangular in shape and is divided into a thumb stall and a finger stall. Because of the rectangular shape, there is considerable slack in the covering when it is put on. This slack makes it difficult to handle certain types of objects with the hand covering on and also tends to allow the hand covering to slip off. In some applications that is a disadvantage, and the present invention overcomes the problems, for instance for food handlers who may handle sticky foods, without loss of the advantages of the patented form.

SUMMARY OF THE INVENTION

In accordance with this invention, the foregoing problems are solved by attaching fastener strips to the back of the sanitary hand covering and positioning the fastener strips so that slack portions of the hand covering can be folded over and fastened down to prevent the hand covering from sliding around or falling off. Preferably these strips have hooks and loops of artifical fibers such as VELCRO, but other fasteners may be used.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 1:
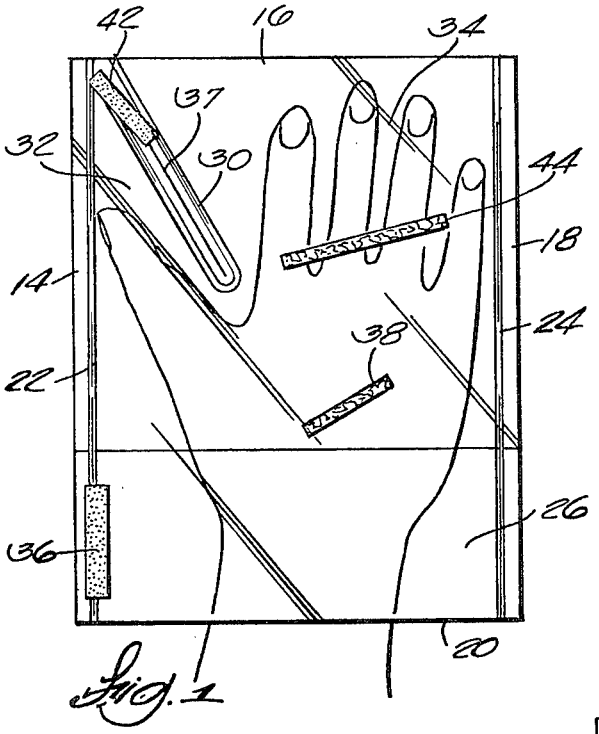
FIG. 1 is a top plan view of one sanitary hand covering embodying this invention with a hand inserted therein.
Figure 2:
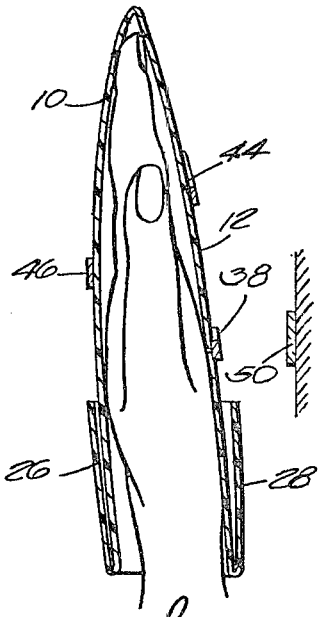
FIG. 2 is a longitudinal sectional view taken on the line 2—2 of FIG. 1.

The hand covering of this invention is made from two adjacent rectangular sheets 10 and 12 (FIG. 2) of plastic film which are fastened together on three sides 14, 16 and 18 (FIG. 1) and are open on one side 20. In this particular embodiment, the rectangular sheets 10 and 12 are integrally joined together at side 16, which is formed by folding over an elongated rectangular piece of plastic film upon itself. Side edges 14 and 18 are heat sealed together along strips 22 and 24 respectively. At the open end 20, rectangular sheets 10 and 12 are folded back upon themselves to form cuffs 26 and 28 (FIG. 2) which are heat sealed together at their side edges by heat seal strips 22 and 24.

Rectangular sheets 10 and 12 are also heat sealed together along a U-shaped divider strip portion 30 (FIG. 1) which is positioned to divide the interior of the hand covering into a thumb stall 32 and a finger stall 34. Rectangular sheets 10 and 12 are slit at 37 within U-shaped divider strip portion 30 to provide an opening for hanging the hand covering up on a hook, doorknob, or the like and also to permit movement between thumb stall 32 and finger stall 34.

Figure 3:
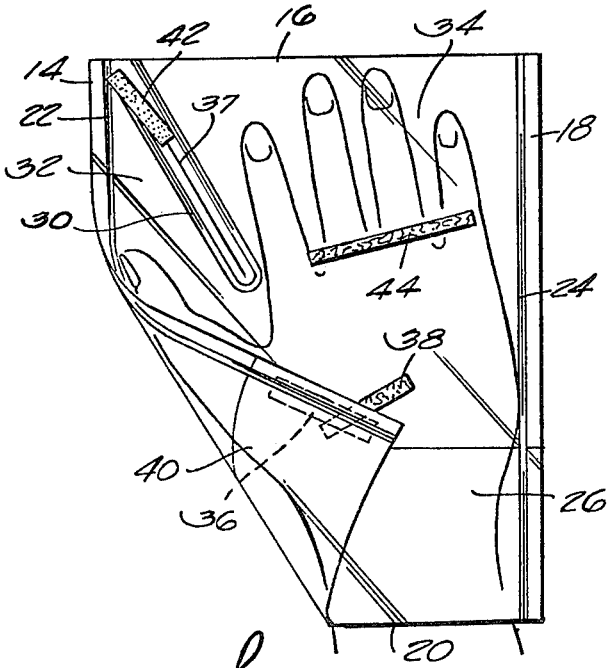
FIG. 3 is a top plan view similar to FIG. 1 showing one corner portion of the hand covering folded over and fastened down to take up slack near the user's lower thumb and wrist.

In some uses, one drawback of rectangular hand coverings such as described above is that there is enough slack between the hand covering and a hand inserted therein to permit the hand covering to slide around in use and to tend to fall off. To prevent this, the hand covering of this invention utilizes fastener strips on the back of the hand covering which are positioned to take up the slack. A first pair of fastener strips 36 and 38 are positioned to take up the slack in the wrist area. Fastener strip 36 is positioned near the junction of open side 20 and closed side 14 beneath thumb stall 32 and is aligned with closed side 14. Fastener strip 38 is positioned in the central portion of the hand covering and is aligned to be transverse to fastener strip 36 when the corner of the hand covering beneath thumb stall 32 is folded over upon itself as shown in FIG. 3 to form a triangular fold 40 which prevents the wrist portion of the hand covering from sliding around and falling off. With the triangular fold 40, there is no way for the hand covering to come off without unfastening fastener strips 36 and 38.

Fastener strips 36 and 38 can be any suitable fasteners but are preferably hook and loop type fasteners such as VELCRO brand fasteners or the like. Alternately, pressure sensitive adhesive material or magnetic material or any linear array of fasteners easily connected and disconnected can be used. Adhesive strips may be covered by release liners to prevent fastener strips 36 and 38 from sticking to anything until it is desired to fasten them together, at which time the release liners would be removed. However, hook and loop type fasteners are preferable.

Figure 4:
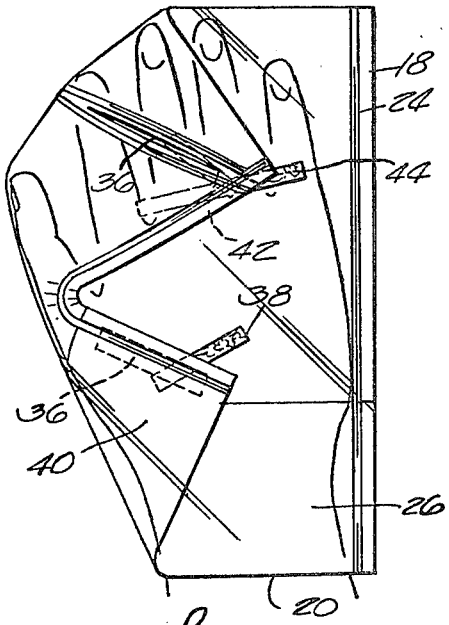
FIG. 4 is a top plan view similar to FIG. 3 and additionally showing another corner portion of the hand covering folded over and fastened down to take up slack near the tip of the user's thumb and index finger.

Another pair of fastener strips 42 and 44 are positioned to take up the slack at the other end of the hand covering. Fastener strip 42 is located near the junction of closed sides 14 and 16 above thumb stall 32 and is approximately aligned with U-shaped seal strip 30. Fastener strip 44 is located in the lower portion of finger stall 34 and is approximately aligned with fastener strip 38. To take up the slack above thumb stall 32, the corner of the hand covering above thumb stall 32 can be folded over and fastened down by fastener strips 42 and 44 as shown in FIG. 4.

Figure 5:
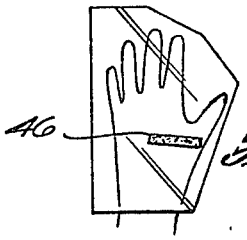
FIG. 5 is a view similar to FIG. 4 but showing the palm side of the hand covering.

For the purpose of increasing the gripping power of the hand covering, a gripper strip 46 (FIGS. 2 and 5) which can be any suitable rough material, but which is preferably a strip of hook type fastener material, is affixed to bottom sheet 10 in the central portion of thumb stall 32. Gripper strip 46 is approximately aligned with the open end 20 of the hand covering.

It will be understood that if it is not desired to use a hook to hang my hand covering by the slit provided a complementary fastener 50 may be placed on a convenient surface to mate with those of my hand covering. In this manner the fasteners serve a dual function.

I claim:

1. In a rectangular sanitary hand covering made by two adjacent sheets of plastic film material having three closed sides and one open side surrounding a central portion, a divider portion of said sheets being sealed together around an opening that does not intersect any side to divide the interior thereof into a thumb stall and a finger stall, the improvement comprising at least one pair of fasteners affixed to the outer surface of one sheet, one of said fasteners being positioned adjacent to the junction of said open side and one closed side of said hand covering, and the other fastener being positioned in the central portion of the outer surface of the same sheet in position to interact with the first mentioned fastener in closing the slack portion around the open side of said hand covering when it is on a person's hand to prevent the hand covering from falling off the person's hand.

2. The hand covering of claim 1 wherein both fasteners are elongated strips engageable with each other in a plurality of positions along each said strip, the first mentioned fastener strip being positioned in approximate alignment with the adjacent closed side of said hand covering and the other fasterner strip being positioned transverse to said first fastener strip.

3. The hand covering of claim 1 wherein said fasteners are hook, and loop fasteners.

4. The hand covering of claim 1 and further comprising third and fourth fasteners affixed to the outer surface of said sheet, said third fastener being positioned adjacent to the junction of two closed sides of said hand covering above said thumb stall, and said fourth fastener being positioned near the bottom of said finger stall in position to interact with said third fastener in closing the slack portion in said hand covering between said thumb and finger stalls.

5. The hand covering of claim 4 wherein all of the fasteners are elongated strips, the first mentioned fastener strip being positioned in approximate alignment with the adjacent closed side of said hand covering, the second fastener strip being positioned transverse to said first fastener strip, said third fastener strip being positioned in alignment with said divider portion, and said fourth fastener strip being positioned transverse to said third fastener strip.

6. The combination comprising a rectangular sanitary hand covering made of two adjacent sheets of plastic film material having three closed sides and one open side surrounding a central portion, a divider portion of said sheets sealed together around an opening that does not intersect any side to divide the interior thereof into a thumb stall and a finger stall, at least one pair of fasteners affixed to the outer surface of one sheet, one of said fasteners being positioned adjacent to the junction of said open side and one closed side of said hand covering, and the other fastener being positioned in the central portion of the outer surface of the same sheet in position to interact with the first mentioned fastener in closing the slack portion around the open side of said hand covering when it is on a person's hand to prevent the hand covering from falling off the person's hand and a third fastener of a type to interact with one of said pair of fasteners, said third fastener being attached to a supporting surface for supporting said hand covering when it is not in use.

* * * * *